United States Patent [19]

Matsuo et al.

[11] Patent Number: 4,763,111

[45] Date of Patent: Aug. 9, 1988

[54] DOOR CLOSER HAVING SOUND GENERATING FUNCTION

[75] Inventors: Isamu Matsuo; Junji Mori, both of Hiroshima, Japan

[73] Assignee: Ryobi Ltd., Hiroshima, Japan

[21] Appl. No.: 772,803

[22] Filed: Sep. 5, 1985

[30] Foreign Application Priority Data

| | | | |
|---|---|---|---|
| Sep. 5, 1984 | [JP] | Japan | 59-135630[U] |
| Jan. 31, 1985 | [JP] | Japan | 60-13278[U] |
| Apr. 19, 1985 | [JP] | Japan | 60-59163[U] |
| Jul. 29, 1985 | [JP] | Japan | 60-116892[U] |

[51] Int. Cl.[4] ..... G08B 13/08; H01H 3/16

[52] U.S. Cl. ..... 340/545; 200/61.62; 340/547; 340/549; 340/693

[58] Field of Search ..... 340/545–547, 340/549, 693; 200/61.7, 61.62, 61.93; 49/13

[56] References Cited

U.S. PATENT DOCUMENTS

| | | | |
|---|---|---|---|
| 3,973,357 | 8/1976 | Kluempers | 200/61.62 X |
| 4,016,381 | 4/1977 | Rodseth | 200/61.7 X |
| 4,335,376 | 6/1982 | Marquardt | 340/547 |
| 4,339,747 | 7/1982 | Maybee | 340/547 |
| 4,583,081 | 4/1986 | Schmitz | 340/545 |

*Primary Examiner*—Joseph A. Orsino, Jr.
*Assistant Examiner*—Thomas J. Mullen, Jr.
*Attorney, Agent, or Firm*—Sughrue, Mion, Zinn, Macpeak, and Seas

[57] ABSTRACT

A door closer which is capable of issuing a selected sound or remaining silent when the associated door is opened and which can be mounted on an existing door opener mechanism. Two covers are provided which are mounted on opposite ends of a door closer mechanism body. One of the two covers carries a speaker, while the other carries a sound generating circuit, sensors, and a changeover switch. The changeover switch is used for selecting among, for instance, an alarm sound, a melody chime, and silence. An operating lever for the changeover switch extends through the cover to the outside for ease of selection.

4 Claims, 7 Drawing Sheets

DOOR CLOSER HAVING SOUND GENERATING FUNCTION

BACKGROUND OF THE INVENTION

The present invention relates to a sound generator for a door closer and which is adapted to be interiorly or exteriorly mounted on, for example, a parallel (standard-type) door closer or various other types of conventional door closers to sense the opening of door and to generate sound in response.

A calling device has been heretofore well known which sounds a chime, melody chime, alarm, or the like when a door is opened. Such a calling device is, however, generally provided in a box mounted separately of the door closer.

Disadvantages derived from mounting the calling device in such a manner include complex installation and poor design appearance. Where the door closer is designed to be usable with both left- and right-hinged doors, it is impossible for a sensor of the calling device, which senses movement of a magnet secured to an arm attached to the door, to detect the direction of movement of the door. Moreover, if the sensor is disposed on the side of a speaker of the calling device, measures must be taken so that the sensor senses only the magnetic force of the arm and not that of the speaker. This necessitates the use of precision components and involves difficulties in manufacture and assembly.

SUMMARY OF THE INVENTION

It is an object of the invention to overcome the aforementioned difficulties by providing a sound generating apparatus mounted in a cover for a door closer body to thus provide the sound generating apparatus and door closer as a single unit.

Moreover, it is a further object of the invention to provide such a sound generating apparatus in which selection of various sounds, such as a melody chime and an alarm sound, is automatically effected to identify the caller by the sound.

In accordance with these and other objects of the invention, a door closer having a sound generating function is provided which comprises two interchangeable detachable covers mounted on a main body of the door closer at opposite ends thereof, a sound generator disposed in one of the detachable covers two sensors mounted therein on opposite ends thereof, and a speaker positioned in the other detachable cover, whereby the one cover may be interchanged with the other depending upon whether the door is a left- or right-hinged door.

With this arrangement, movement of the door when opened is sensed accurately and reliably and without influence of the magnetic force of the speaker. The closer may be readily manufactured and assembled at a low price.

It is a further object of the invention to provide a sound generator which is capable of being detachably mounted on various conventional door closers presently on the market.

In accordance with this object of the invention, a door closer is provided including a main body of the door closer; a substrate provided with a power source, various electrical components and a speaker forming a circuit constituting a melody chime, alarm, or the like; and a sound generating device including a triple or double changeover switch for selecting the sound to be produced and providing an ON-OFF action. The sound generating device is mounted in the cover as to sense the movement of the door when opened and to produce sound in response to such movement. Further, a changeover lever for the triple or double changeover switch is operatively extended from inside the cover to the exterior.

Still further, the drawbacks of the prior art are overcome by a door closer including a pair of detachable covers removably mounted on a door closer main body at opposite ends thereof, the two covers being interchangeable with one another at the opposite ends of the main body. One cover is provided therein with a sound generating device which includes a power source, various electrical parts, and a changeover switch, together constituting a circuit capable of producing a melody chime, an alarm, or the like. Two sensors are mounted at opposite ends of the one cover for sensing the opening movement of the door. The other cover has a speaker mounted therein, which is driven by the sound reproducing device.

Alternatively, in accordance with the invention, a main body cover is formed so as to be mountable on various conventional and existing door closers. In this case, the main body cover incorporates therein a sound generating device which comprises a sound generating circuit constituted so as to produce sound upon sensing the opening movement of the door, a power source, a speaker, a changeover switch, a sensor, and other required electric parts.

The invention will become apparent from the following detailed description of preferred embodiments thereof and with reference to the accompanying drawings.

DESCRIPTION OF THE PREFERRED EMBODIMENTS

Figure 1:
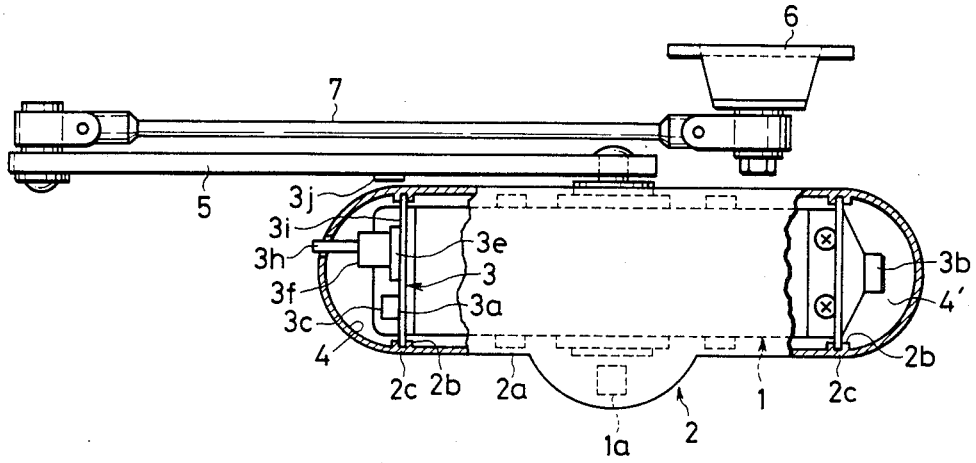
FIG. 1 is a front view showing, partly in section, a preferred embodiment of a door closer having sound generating function.

Referring to FIG. 1, a door closer body 1 is provided with a cover 2. A sound producing device (sound generator) 3 is disposed in the body 1.

The cover 2, which holds the door closer body 1 together as a unit, is secured directly to a door (not shown). A retainer rib (not shown) disposed in the interior of a shell 2*a* engages a recess (not shown) formed in the outer wall of the closer body 1 to clamp these two members together. Otherwise, a set screw or the like can be employed.

The cover 2 is dimensioned to have a length somewhat greater than that of the closer body 1 to define spaces 4, 4' at opposite ends thereof, in one such space 4, the sound generating device 3 is mounted. More specifically, the cover 2 is provided in the interior of the shell 2*a* with grooves 2*c*, formed in ribs 2*b* at opposite ends thereof, in which are received a substrate 3*a* and a speaker 3*b*.

The door closer body 1 carries a pinion shaft 1*a* to which one end of an arm 5 is fixed in the same manner as in the conventional closer body. Another arm 7, pivotally coupled to the other end of the arm 5, is provided with a fitting 6 to be secured to a door mounting frame (not shown). The rotary shaft 1*a*, rotated by. movement of the door when opened, produces an energizing force used for closing the door with the use of a spring.

Figure 2:
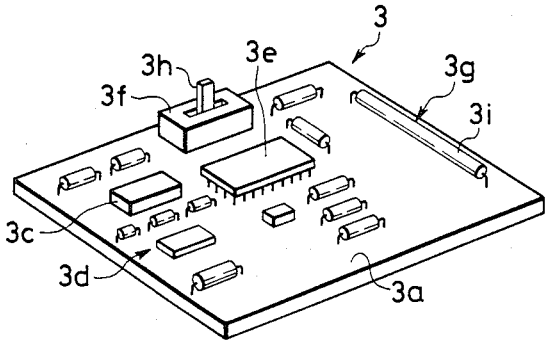
FIG. 2 is a perspective view of a sound generating device for the door closer.

The sound generator 3, as shown in FIGS. 1 and 2, is formed on a substrate 3*a*, the latter supporting a battery 3*c*, various electric components 3*d*, a sound generating circuit 3*e*, a triple changeover switch 3*f*, a sensor 3*g*, and selected components. The sound generator is disposed in the space 4 of the cover, while the speaker 3*b* is positioned in the space 4'. The sound generator can produce at least two readily distinguishable sounds such as an alarm sound and a melody chime. The triple changeover switch 3*f* is used to select among the alarm sound, melody chime, and a silent position.

The sensor mechanism 3*g*, by way of example, is formed of a normally ON type reed switch 3*i* and a permanent magnet 3*j*. The permanent magnet 3*j*, as shown in FIG. 1, is mounted on the arm 5 and positioned directly above the reed switch 3*i* when the door is closed. Thus, when the door is closed, the reed switch 3*i* will be OFF and no sound will be issued, and when the door is opened, the magnet 3*j* will be moved away from the switch 3*i*, whereupon the switch 3*i* will be placed in the ON state, causing the sound generator 3 to produce the selected sound. The sound generator 3 stops the sound after a predetermined time.

If desired, the above-described magnetic-type sensor can be replaced by an infrared-type sensor which senses a portion of the arm and the mounting frame.

Figure 4:
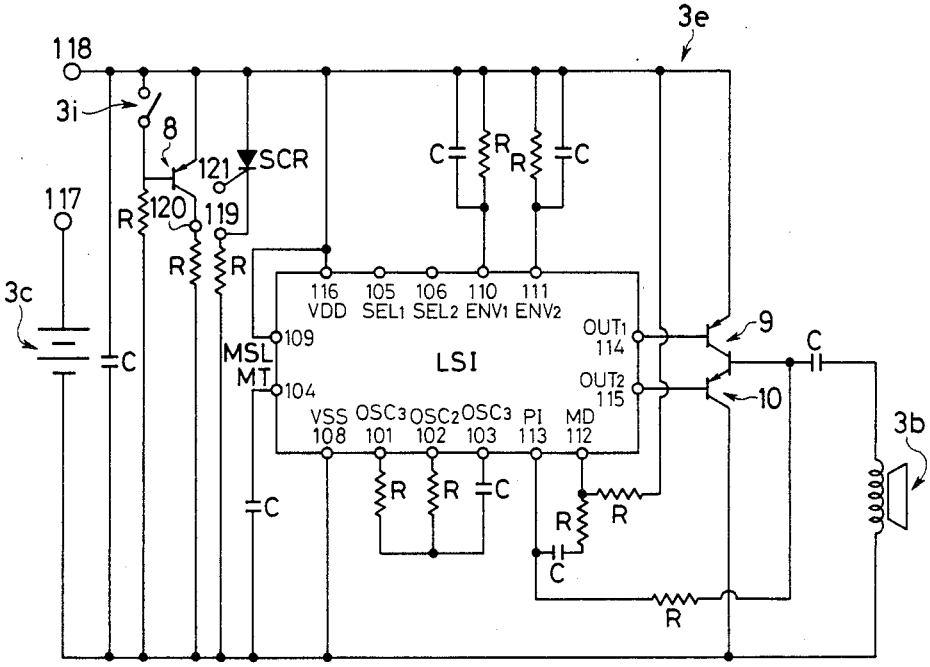
FIGS. 4 and 6 are circuit diagrams each illustrating, by way of example, a sound generating circuit for the door closer.
Figure 6:
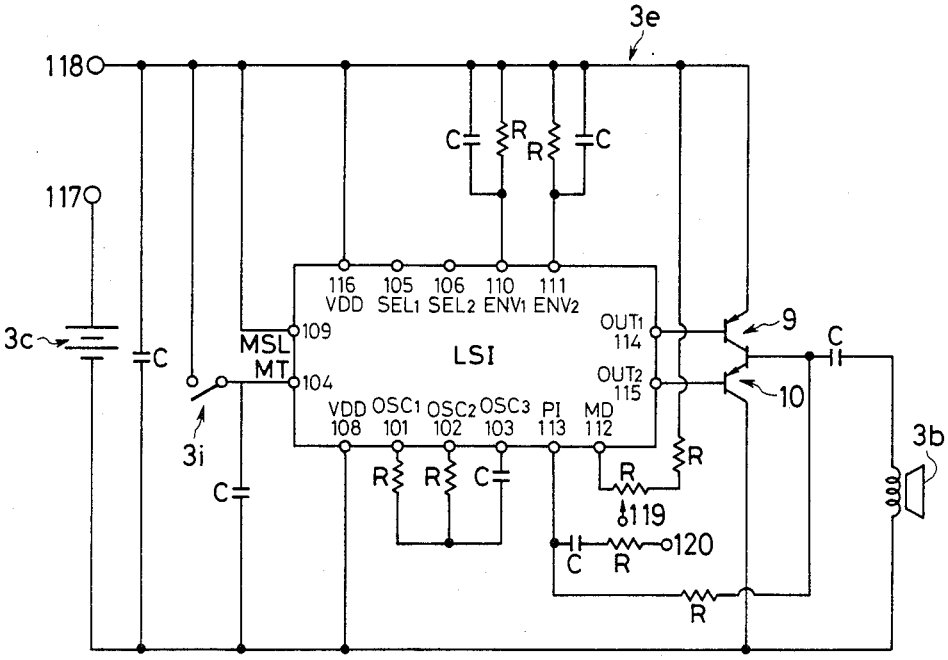

A circuit arranged as shown in FIGS. 4 and 6 is used as the sound generating circuit 3*e*.

Figure 3A:
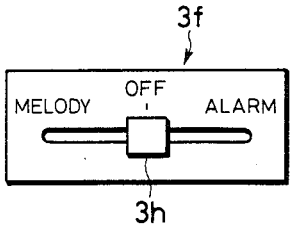
FIGS. 3A and 3B and FIGS. 5A and 5B are front explanatory views, the former showing a triple changeover switch for the door closer and the latter being explanatory of the manner of its connection.
Figure 3B:
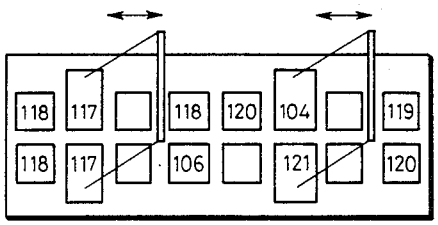

In the circuit of FIG. 4, when an alarm is to be sounded, contacts 117–106, 121–120, 104–119, 117–118 of the triple changeover switch 3*f* shown in FIGS. 3A and 3B are interconnected so that, when the reed switch 3*i* is ON, a transistor 8 is turned ON and an SCR fired. Thus, a terminal MT 104 of a sound generator integrated circuit LSI is at an H (high, positive) level. Then, an alarm signal is amplified by transistors 9 and 10 to sound the alarm signal through the speaker 3*b*.

At this time, the type of sound issued (alarm sound) is selected by an H-level signal applied to a select input terminal $SEL_2$ (106) of the LSI. It is noted that the alarm is continuously sounded even if the door is immediately closed since the SCR remains on after firing. On the other hand, if it is desired to sound the melody chime, the triple changeover switch 3*f* is set so as to interconnect the contacts 118–117 and 120–104. When the reed switch 3*i* is ON, the transistor 8 is turned ON and the MT terminal 104 of the LSI is set to the H level. The melody chime signal is then outputted at the output terminals $OUT_1$ (114) and $OUT_2$ (115) and amplified by the transistors 9 and 10 to issue the melody chime sound through the speaker 3*b*. The melody chime is outputted since an active input is received on only the terminal 104.

Figure 5A:
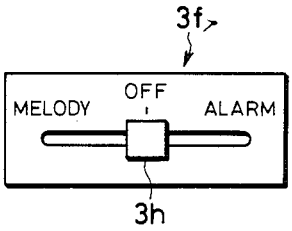
Figure 5B:
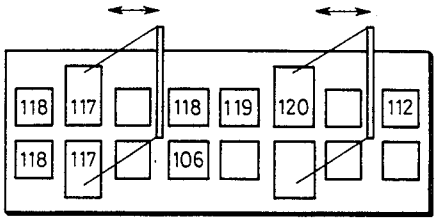

The functions of the terminals of the LSI are as follows:

108 (negative input), 106 (positive input): power source inputs for the LSI 101, 102, 103: choice of frequency to be outputted 113, 112: determination of magnitude of sound before passing through pre-amplifier 110, 111: adjustment of time constant to set speed For sounding the alarm, the triple changeover switch 3*f* shown in FIGS. 5A and 5B interconnect the contacts 117–106, 117–118, and 120–112. When terminal 104 is set to the H level, and the alarm signal is then outputted at the output terminals $OUT_1$ (114) and $0UT_2$ (115). The alarm signal, selected by the H-state signal applied to the $SEL_2$ terminal 106, is shut off when the door is closed and the reed switch 3*i* is OFF. The contacts 120 and 112 are connected to each other to establish the sound volume.

For sounding the melody chime, the triple changeover switch 3*f*, as shown in FIGS. 5A and 5B, is set to connect the contacts 117–118 and 119–120 with each other. When the reed switch 3*i* is ON, the MT Terminal of the LSI is set to the H level. The melody chime signal is then outputted at the output terminals $OUT_1$ (114) and $OUT_2$ (115) and amplified by the transistors 9 and 10 to produce the melody chime through the speaker.

FIGS. 3B and 5B show, respectively, how the respective contacts are connected in the instances where the alarm and the melody chime are sounded.

As already mentioned, the triple changeover switch 3*f* is operated via the changeover lever 3*h*. Preferably, the melody chime is employed when visitors are to have access to the interior. The melody chime is not continuously sounded even if visitors successively pass through the door and the door is held open. This economizes electric power and eliminates unwanted noise. A playing time of five to ten seconds may prove satisfactory. If desired, the triple changeover switch 3f may be set to the OFF (silent) position so that neither the sound of the alarm nor that of the melody chime can be produced.

When the alarm is sounded, such as for the purpose of signaling the presence of an intruder, the sound generating circuit causes the alarm sound to be continuously sounded until the triple changeover switch 3*f* is turned OFF. The alarm sound should continue even if the door is closed.

Next, another embodiment in which the door closer can be used for both left- and right-hinged doors will be described.

Figure 7:
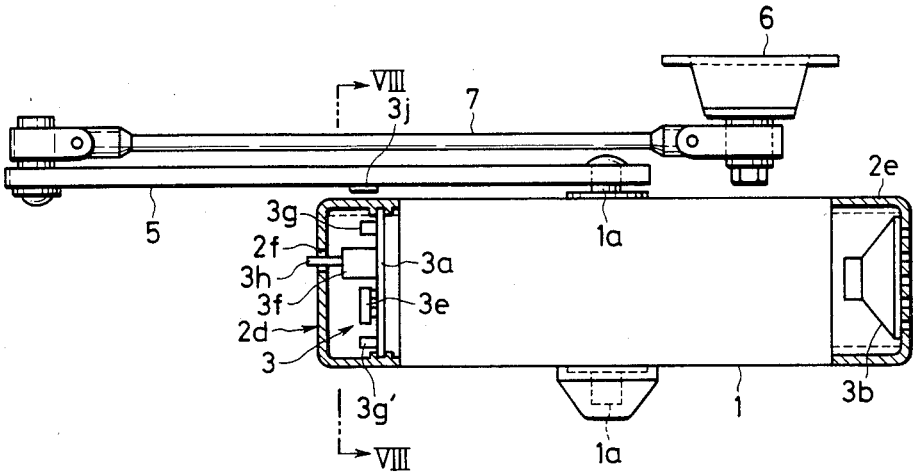
FIG. 7 is a front view showing, partly in section, another embodiment of a door closer having a sound generating function.
Figure 8:
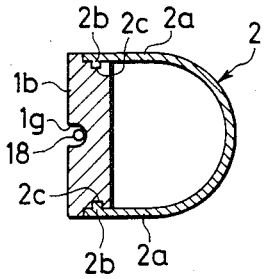
FIG. 8 is a cross section taken along a line II—II in FIG. 7.
Figure 9A:
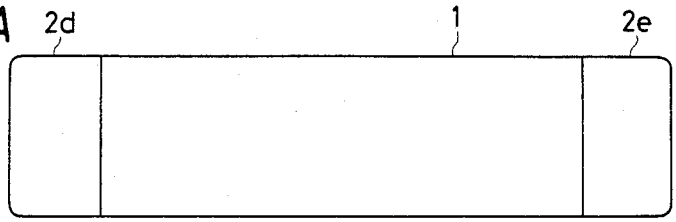
FIGS. 9A, 9B, 9C and 9D are front views, each showing a modified form of a cover of the second embodiment.
Figure 9B:
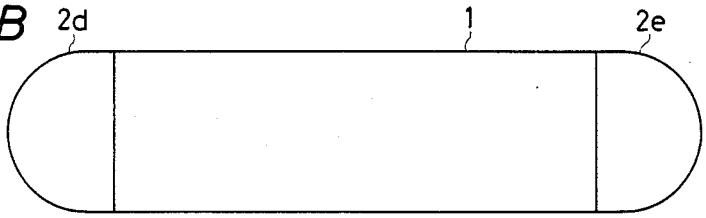
Figure 9C:
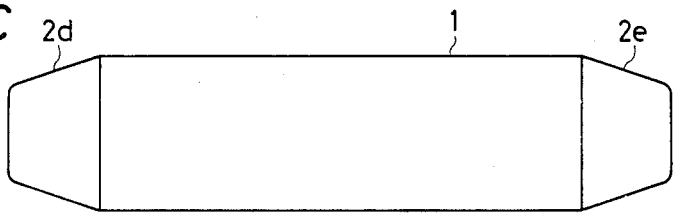
Figure 9D:
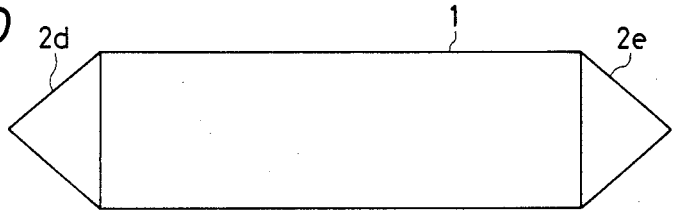
Figure 10:
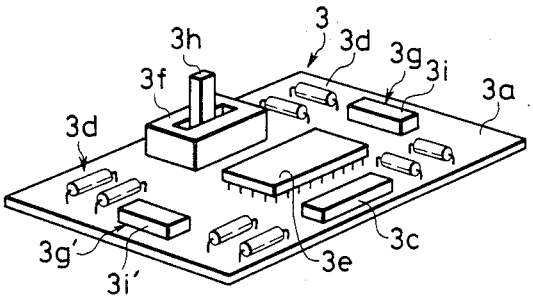
FIG. 10 is a perspective view showing a sound generating device and a sensor of the second embodiment.

As seen from FIGS. 7 and 8, the door closer body 1 is provided at opposite ends with two detachable covers 2*d* and 2*e*. One cover 2*d* encloses the sound generating device 3 and two sensor mechanisms 3*e* and 3*e'*, disposed vertically opposite to each other, whereas the other cover 2*e* holds therein the speaker 3*b*.

The covers 2*d* and 2*e* are fabricated so that they can be removably mounted on the closer body 1 at the opposite ends thereof and are interchangeable with each other. Preferably, the two covers 2*d* and 2*e* have the same dimensions and are symmetrical with each other to provide a good appearance. Acceptable shapes are shown in FIGS. 9A through 9D.

Four mounting seats 16 are provided which symmetrically extend from the closer body 1 at opposite ends thereof. The two covers 2*d* and 2*e*, the bases of which are open, are received therein. Mounting seats 1*b* are formed on the peripheral wall with grooves 2*c*. The covers 2*d* and 2*e* include respective shells 2*a* having retainer ribs 2*b* which engage the grooves 2*c* so that the body 1 and the covers are held together as a unit. The covers 2*d* and 2*e* are removably mounted on the body 1 by set screws or the like, or other well known means.

The sound operating device 3 to be mounted on the cover 2*d* carries on the substrate 3*a* a power source 3*c* such as a battery or the like, various electric components 3*d*, the sound generating circuit 3*c*, the changeover switch 3*f*, two sensors 3*g* and 3*g'*, and other required electric parts, thus constituting a circuit with which the melody chime, alarm sound, and the like are produced. The substrate 3*a* is secured to the interior of the case 2 by a suitable clamping structure to hold the sound generating device 3, the two sensors 3*g* and 3*g'*, and the covers together as a unit.

The two sensors 3*g* and 3*g'* are arranged so that, as shown in FIG. 7, one of them (3*g*) is disposed opposite to the arm 5 fixed to the pinion shaft 1*a* of the closer body 1 when the door closer is in use.

Although operation of the changeover switch 3*f* may be carried out in the case where the cover 2 is removed from the closer body 1, preferably the changeover lever 3*h* is extended through an aperture 2*f* formed in the cover 2 so that operation of the switch 3*f* may be performed more readily.

The sensor mechanisms 3*g* and 3*g'* are preferably implemented with normally ON type reed switches 3*i* and a permanent magnet 3*j*.

As is apparent from FIG. 7, the permanent magnet 3*j* is mounted on the arm 5 in such a manner that it is positioned directly above the reed switch 3*i* when the door is closed. When the door is opened, the arm 5 is rotated away from the reed switch 3*i* and permanent magnet 3*j* to turn the switch ON and to thus cause production of the selected sound. As above, the melody chime is ceased after a predetermined time period, preferably at the end of a tune, that is, it is halted irrespective of further opening and closing of the door.

The covers 2*d* and 2*e* can be interchanged with each other to change between left- and right-hinged doors.

The speaker 3*b* mounted in the cover 2*e* is connected to the sound producing device 3. For this purpose, a wiring groove 1*g* is formed longitudinally on the back of the closer body 1, as shown in FIG. 8, to accommodate connecting wiring. Hence, the wiring is not exposed to the outside, attaining a good appearance and preventing damage to the wiring.

The door closer body 1 carries a rotary shaft la to which one end of the arm 5 is fixed in the same manner as in the conventional closer body. Another arm or link 7 is pivotally connected at one end to the other end of the arm 5. The other end of the link 7 is pivoted to a bracket 6 secured to the door mounting frame (not shown). The rotary shaft 1*a* is thus rotated by movement of the door upon opening. Biasing forces are applied in the conventional manner.

The arrangement shown in FIGS. 4 and 6 may be applied as well to the sound producing circuit 3*e* of the aforementioned embodiment.

Although a triple changeover switch has been described for selecting among various sounds to be produced and an OFF position, a double changeover switch can be used, as will now be described.

Figure 11:
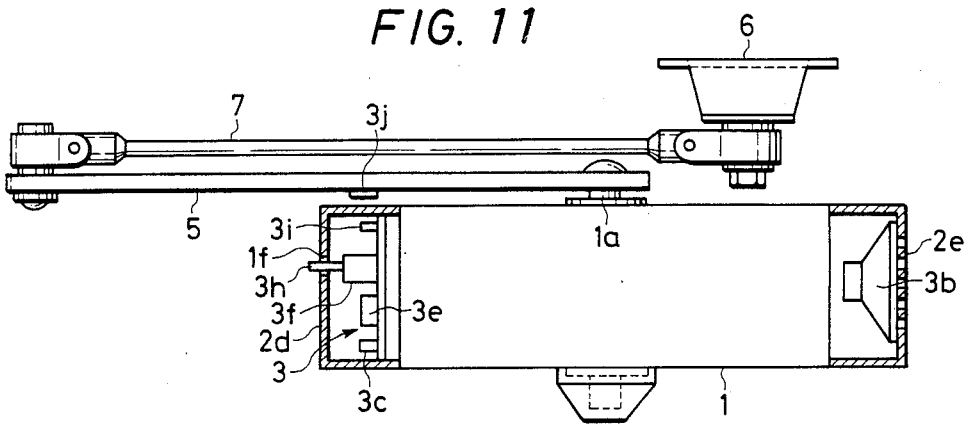
FIG. 11 is a front view showing, partly in section still another embodiment of a door closer having a sound generating function.
Figure 12:
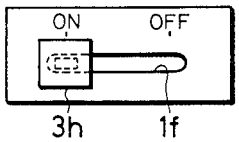
FIG. 12 is a front view of a double changeover switch used in the third embodiment.
Figure 13:
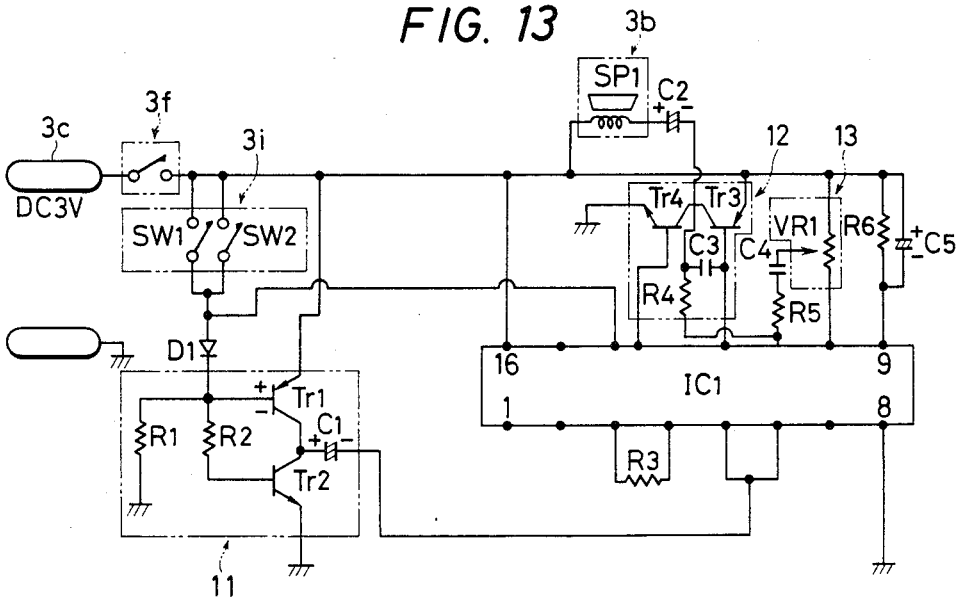
FIG. 13 is a diagram showing a sound generating circuit used in the third embodiment.

As shown in FIGS. 11 to 13, to the door closer body 1 is attached a reed switch 3*i* which is turned ON and OFF by a magnet 3*j* mounted on the arm 5, similar to the previously discussed case. In this case, the changeover switch 3*f* is a double changeover switch 3*f* for selecting between ON and OFF states, that is, between sound production and silence.

The sound producing device 3 is mounted in a cover (not shown) surrounding the door closer body 1, removably mounted on the closer body 1 or the covers 2*d* and 2*e* at opposite ends thereof, as described above. A lever 3*h* of the double changeover switch 3*f*, used to operate the switch 3*f*, extends through the aperture 1*f* in the cover 2*d* to the outside, as shown in FIGS. 11 and 12. The reed switch 3*i* is positioned opposite to the magnet 3*j* on the arm 5 when the door is closed, as shown in FIG. 11.

Even if the double changeover switch 3*f* is turned ON, switch sections $SW_1$ or $SW_2$ of the reed switch 3*i* are turned ON by the magnet 3*j* to inhibit sound production when the door is closed. If the double changeover switch 3*i* is turned ON, when the arm 5 is rotated to cause the reed switch 3*i* to move away from the magnet 3*j* by movement of the door when being opened, the reed switch 3*i* is turned OFF, thereby effecting the production of sound. Also, as in the previously described embodiments, the sound is turned OFF after a given period of time when the door is held open. If the door is closed immediately after it is opened, the reed switch 3*i* upon again reaching the position facing the magnet 3*j*, is closed, thereby turning the reed switch 3*i* ON and ceasing the production of the sound.

In the sound producing circuit 3*e* shown in FIG. 13, the switch sections $SW_1$ and $SW_2$ of the reed switch 3*i* are turned ON when the magnet is moved to a position near the reed switch 3*i* as the door is closed. When the door is opened, the magnet 3*j* is moved away from the reed switch 3*i* to turn the switch sections $SW_1$ or $SW_2$ of the reed switch 3*i* OFF. This action causes a transistor $Tr_1$ of a switch inverter circuit 11 to be turned off and a transistor $Tr_2$ to be turned on, hence connecting a charged capacitor $C_1$ to an actuation input of a sound generating integrated circuit $IC_1$ and effecting the production of sound. As the door is moved to the closed position, the magnet 3*j* approaches the reed switch 3*i*, actuating the switch 3*i* and turning on the switch sections $SW_1$ and $SW_2$. This renders the transistor $Tr_1$ conductive and turns OFF the transistor $Tr_2$, hence instructing the circuit $IC_1$ to produce no sound.

The sound signal is amplified by an amplifier 12 to issue the sound from the speaker 3*b*. The sound volume is optionally adjusted by a volume control 13.

The door closer body 1 carries a rotary shaft 1*a* to which one end of the arm 5 is fixed in the same manner as in the conventional closer body and as described above.

Another arm 7 is pivotally coupled to the other end of the arm 5 and provided with a metal bracket 6 to be secured to the door mounting frame (not shown). The rotary shaft 1*a* is rotated upon movement of the door. The door closer body 1 is constructed in such a manner as to be usable with both left- and right-hinged door.

Another exemplary embodiment of the invention, in the form of a cover for a door closer having a sound generating capability, will now be described with reference to FIGS. 14 through 17. In this case, the cover body 2 is dimensioned so as to conform to a door closer body of a conventional parallel type used for a front door, kitchen door, interior room door, or the like. Openings are formed in the corresponding wall to receive levers of the changeover switches and baffle boards. The dimensions of the cover body 2 are varied according to the space required in the cover to receive the sound producing device, speaker, and other such parts. The cover body can measure, for example, 24 mm in depth, in consideration of common dimensions of conventional door closer bodies.

Figure 14:
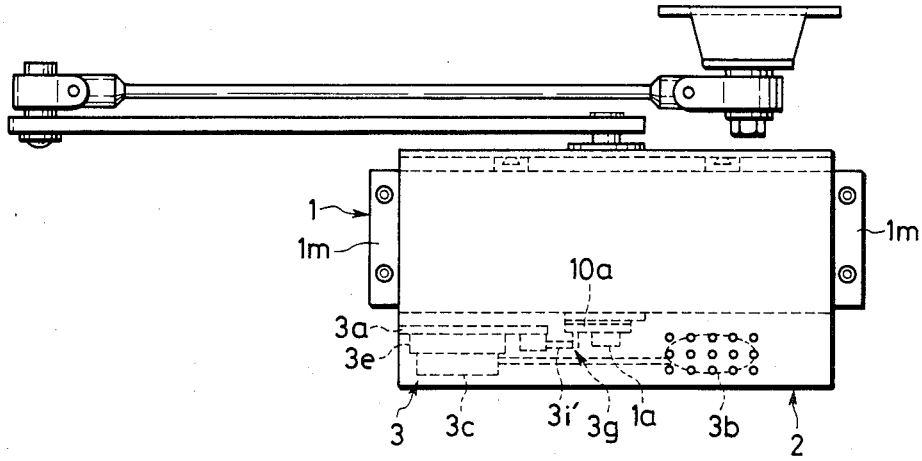
FIG. 14 is a front view of one form of a cover for a door closer having a sound generating device mounted thereon.

The cover body 2 generally covers the closer body 1 except for the rear part 1' thereof, and may have mounting seats lm formed at opposite ends of the closer body as shown in FIG. 14.

Figure 16:
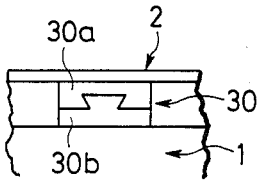
FIG. 16 is a front elevational view showing a clamp structure for a cover and door closer main bodies shown in FIG. 15.
Figure 17:
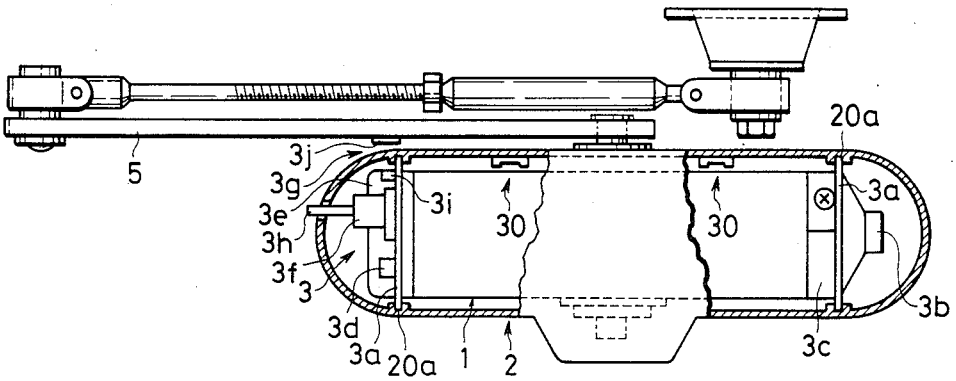
FIG. 17 is a front view, partly in section, showing another embodiment of the invention.

The cover body 2 is of course required to be secured to the door closer body 1. For this purpose, a clamping structure 30 is provided, arranged in such a manner that the two components are snugly fitted but the cover body can be readily mounted and removed. For the clamping structure 30, a retainer boss or a curved leaf spring is mounted on one of the surfaces of the cover or the door closer body. As shown in FIG. 16, a dove-tailed grooved member 30*a* and a dove-tailed member 30 may be provided for this purpose.

The cover body 2 is completed by provision of the sound generating circuit 3*e* by which the sound is generated upon sensing the movement of the door when opened, the power source 3*c*, the speaker 3*b*, the changeover switch 3*f*, the sensor 3*g*, and other required electric parts 3*d*. The respective parts of the sound generating device 3 are secured to the substrate 3*a*. The substrate 3*a* is directly fixed to the interior of the cover body 2 or fitted into and made fast with a retainer groove 20*a* formed in the interior of the cover body 2.

The sound generating device 3 may be a circuit with which one sound such as an alarm sound or melody chime can be produced, or one with which two sounds can be produced. If only one sound can be produced, a double changeover switch is used to select between ON and OFF states. If two sounds can be produced, a triple changeover switch is used to select among the two sounds and the OFF state.

Figure 15:
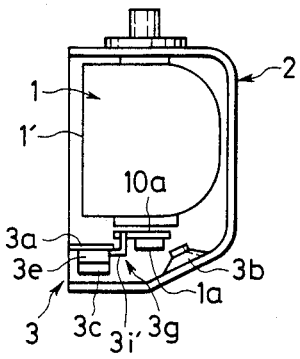
FIG. 15 is a side view of the same.

Various sensors 3*g* have been mentioned. In a further sensor arrangement, a contact member 10*a* attached to the pinion shaft 1*a* of the door closer body 2, as shown in FIGS. 14 and 15, serves to change a switch 3*i* between ON and OFF positions by contact therewith FIG. 15. In a still further arrangement shown in FIG. 17, the reed switch 3*i* and the permanent magnet 3*j* are constituted in the same manner as in the aforementioned embodiment. An infrared sensor (not shown) is provided for sensing the positions of a portion of the arm 5 and the mounting frame. The permanent magnet 3*j* is mounted on the arm 5 so as to be positioned immediately above the reed switch 3*i* when the door is closed to control the reed switch 3*i* in the manner previously described.

The embodiments of FIGS. 4, 6 and 13 may be used with the sound generating circuit of this embodiment.

In the door closer having a sound generating capability fabricated as aforementioned, the sound generating device 3 is integrated with the door closer body 1 in the cover 2 and not exposed to the outside. This provides for easy installation and yields a better overall design appearance.

Moreover, with the provision of the triple changeover switch, during normal use, the device can easily be set to play the chime melody when appropriate, and at other times, such as at night, the alarm can be set. Also, the device can easily be silenced during periods when no sound output is desired. Further, if a succession of visitors passes through the door, the chime melody is played only once, reducing the consumption of electrical power and preventing unwanted noise. Because the speaker and sensor are mounted in the cover and integrated with the door closer body with the detachable covers being mounted on the door closer body on opposite ends thereof, one of the two covers carrying the two sensors and the other the speaker, the device can readily be set to accommodate either a left- or right-hinged door. Moreover, the device can easily be installed and presents a pleasing appearance. The two covers can readily be mounted on most currently available door closer mechanism bodies.

This completes the description of the preferred embodiments of the invention. Although preferred embodiments have been described, it is believed that numerous modifications and alterations thereto would be apparent to one of ordinary skill in the art without departing from the spirit and scope of the invention.

We claim:

1. A door closer having sound generating capability, comprising: a door closer mechanism body, a cover shaped to fit over at least a portion of said door closer mechanism body; sound generating means comprising a substrate mounted interiorly of said cover, a sound generating circuit formed on said substrate, a speaker mounted interiorly of said cover, and changeover switch means mounted interiorly of said cover and coupled to said circuit for selecting circuit operation between sound generation of at least one sound and silence; sensor means carried by said cover for sensing opening movement of a door on which said closer is mounted, said sensor means being coupled in said circuit to actuate said circuit when said door is opened; and an operating lever carried by said changeover switch means for making said sound selection, via said changeover switch means, said operating lever extending through said cover for access externally of said cover, and wherein said sensor means includes switch means within said door closer mechanism body and second, relatively moveable means responsive to door opening and closing for changing the state of said sensor switch means, and wherein said cover comprises two cover halves mounted on said closer mechanism body at opposite ends thereof, said cover halves being symmetrical with one another and being interchangeable with one another.

2. The door closer in claim 1, wherein one of said cover halves carries said speaker and the other of said cover halves carries said sensor means, said sound generating circuit, and said changeover switch means.

3. The door closer of claim 1, wherein said changeover switch means comprises a triple changover switch for selecting among an alarm sound, a chime melody, and silence.

4. A door closer having sound generating capability, comprising: a door closer mechanism body, a cover shaped to fit over at least a portion of said door closer mechanism body; sound generating means comprisinq a substrate mounted interiorly of said cover, a sound generating circuit formed on said substrate, a speaker mounted interiorly of said cover, and changeover switch means mounted interiorly of said cover and coupled to said circuit for selecting circuit operation between sound generation of at least one sound and silence; sensor means carried by said cover for sensing opening movement of a door on which said closer is mounted, said sensor means being coupled in said circuit to actuate said circuit when said door is opened; and an operating lever carried by said changeover switch means for making said sound selection, via said changeover switch means, said operating lever extending through said cover for access externally of said cover, and wherein said sensor means includes switch means within said door closer mechanism body and second, relatively moveable means responsive to door opening and closing for changing the state of said sensor switch means, and wherein said sensor means comprises a contact member attached to a lower portion of a pinion shaft of said door closer body to turn in response to opening movement of said door and to contact said switch means connected in said sound generating circuit to actuate said sound generating circuit.

* * * * *